US012054948B2

(12) United States Patent
Moran et al.

(10) Patent No.: US 12,054,948 B2
(45) Date of Patent: Aug. 6, 2024

(54) REINFORCED ROOFING SHAKES

(71) Applicant: Colorado Roofing Products, LLC, Aurora, CO (US)

(72) Inventors: Richard Moran, Aurora, CO (US); James Chase, Bennett, CO (US)

(73) Assignee: Colorado Roofing Products, LLC, Aurora, CO (US)

( * ) Notice: Subject to any disclaimer, the term of this patent is extended or adjusted under 35 U.S.C. 154(b) by 81 days.

(21) Appl. No.: 17/816,603

(22) Filed: Aug. 1, 2022

(65) Prior Publication Data

US 2023/0067251 A1 Mar. 2, 2023

Related U.S. Application Data

(60) Provisional application No. 63/239,461, filed on Sep. 1, 2021.

(51) Int. Cl.
*E04D 1/12* (2006.01)

(52) U.S. Cl.
CPC ..... *E04D 1/12* (2013.01)

(58) Field of Classification Search
CPC ..... E04D 1/12; E04D 1/20; E04D 1/23
See application file for complete search history.

(56) References Cited

U.S. PATENT DOCUMENTS 816,252 A * 3/1906 Price ..... E04D 1/265 52/587.1
4,288,956 A 9/1981 Heck
4,514,947 A * 5/1985 Grail ..... E04D 1/16 524/5
5,307,604 A 5/1994 Tasso
7,537,820 B2 5/2009 Kalkanoglu et al.
7,765,763 B2 8/2010 Teng et al.
8,458,983 B2 6/2013 Propst
(Continued)

FOREIGN PATENT DOCUMENTS

CA 969460 A 6/1975
EP 0011781 B1 1/1983
(Continued)

OTHER PUBLICATIONS

Roofing Shingles, CertainTeed India Roofing Shingles retrieved from website https://www.certainteed.in/portfolios/roofing-shingles/, Aug. 16, 2021 (3 pgs).

*Primary Examiner* — Patrick J Maestri
(74) *Attorney, Agent, or Firm* — Merchant & Gould P.C.

(57) ABSTRACT

A roofing shake includes a first end and an opposite second end. The roofing shake has a tapered profile such that the second end is thicker than the first end. A bottom surface is configured to face a roofing structure when the roofing shake is installed on a roof and an opposite top surface. A first body portion is disposed proximate the first end. The top surface of the first body portion is configured to be at least partially covered by one or more other roofing shakes. A second body portion is disposed proximate the second end. One or more reinforcement members are embedded within the roofing shake and within the second body portion, the one or more reinforcement members positioned adjacent an outer perimeter edge of the second body portion.

18 Claims, 6 Drawing Sheets

(56) References Cited

U.S. PATENT DOCUMENTS

| | | | | |
|---|---|---|---|---|
| 9,410,056 | B2 | 8/2016 | Lagrange | |
| 9,725,907 | B2 | 8/2017 | Harrington et al. | |
| 9,840,851 | B2 | 12/2017 | Propst | |
| 10,011,992 | B2 | 7/2018 | Mallorey | |
| 2005/0210789 | A1 | 9/2005 | Anghel | |
| 2006/0201094 | A1 | 9/2006 | Lassiter | |
| 2016/0229968 | A1* | 8/2016 | Mallorey | E04D 1/22 |

FOREIGN PATENT DOCUMENTS

| | | | |
|---|---|---|---|
| FR | 1259631 | A | 4/1961 |
| FR | 2204582 | A1 | 5/1974 |
| JP | 6371220 | B2 | 8/2018 |

* cited by examiner

REINFORCED ROOFING SHAKES

CROSS-REFERENCE TO RELATED APPLICATIONS

This application claims priority to and the benefit of U.S. Provisional Patent Application No. 63/239,461, filed Sep. 1, 2021, which is incorporated by reference in its entirety herein.

INTRODUCTION

Wood shakes and roof shingles are conventionally made of cedar, redwood, or cypress, all of which are decay resistant. Roof shakes often provide an aesthetically pleasing shadow effect on the roof and nicely complement shake or other natural wood siding, in part due to the upper surface topography, and in part due to the taper that is unique to handsplit, resawn, and tapersplit wood shakes.

However, compared with other commercially available roofing materials (e.g., asphalt shingles), wood shakes are not resistant to fire and some states have passed laws and/or implemented building codes that prohibit or restrict the use of wood shakes or shingles for roofing. Also, wood shakes are prone to expansion and contraction which must be accounted for during installation, may break when subjected to heavy loads, such as falling limbs or workmen, and may become brittle and friable near the end of their useful life.

Accordingly, a shake or shingle may be formed from synthetic materials so that a relatively light weight and fire resistant shake can meet existing codes with regard to fire retardation. However, these synthetic shakes still need to be strong and durable so as to be useable on roofs and other structures.

Reinforced Roofing Shakes

Reinforced roofing shakes are described herein. The roofing shakes may be formed from a polymeric foam material and a plurality of reinforcement members disposed at a bottom end of the roofing shake body. The reinforcement members may be in a U-shaped configuration and correspond at least partially to the outer perimeter shape of the roofing shake body. The reinforcement members increase the strength of the roofing shake and resist the roofing shake body from lifting and curling once installed on a structure (e.g., a roof). Additionally, the reinforcement members increase the roofing shake's resistance to wind loads. Further, the configuration of the reinforcement members do not inhibit the manufacturing molding process for the roofing shake and enables the polymeric foam material to still flow within the mold.

These and various other features as well as advantages which characterize the reinforced roofing shakes described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure in the written description and claims hereof, as well as the appended drawings.

It is to be understood that both the foregoing introduction and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the technology as claimed in any manner, which scope shall be based on the claims appended hereto.

DETAILED DESCRIPTION

This disclosure describes reinforced roofing shakes. The roofing shake is molded with synthetic materials to have the appearance of cedar shakes, slate, or similar products made from natural materials. However, roofing shakes once installed on a structure are exposed to a variety of environmental conditions. For example, UV-rays, hot and cold cycles, wind, rain, hail, and the like. Prolonged exposure to environmental conditions can result in exterior edges of the roofing shake warping and/or curling up and away from the underlying structural surface. Additionally, the more the exterior edges lift away from the underlying surface, the more wind affects the shake and further increases stresses induced on the shake. As such, in the roofing shake described herein reinforcement members are embedded within the body of the roofing shake. The reinforcement members increase the structural rigidity of the body and reduce or prevent the exterior edges from warping and/or curling, while also increasing resistance to wind loading. In aspects, the configuration of the reinforcement members corresponds to the outer perimeter of the body of the roofing shake enables a reaction injection molding process to remain unchanged even with the additional reinforcement members within the mold.

As used herein, directional terms such as "top," "bottom," "front," "back," etc. are used for convenience only and reference the orientation of the roofing shake once installed on a roof. These terms are not to be considered limiting.

Figure 1:
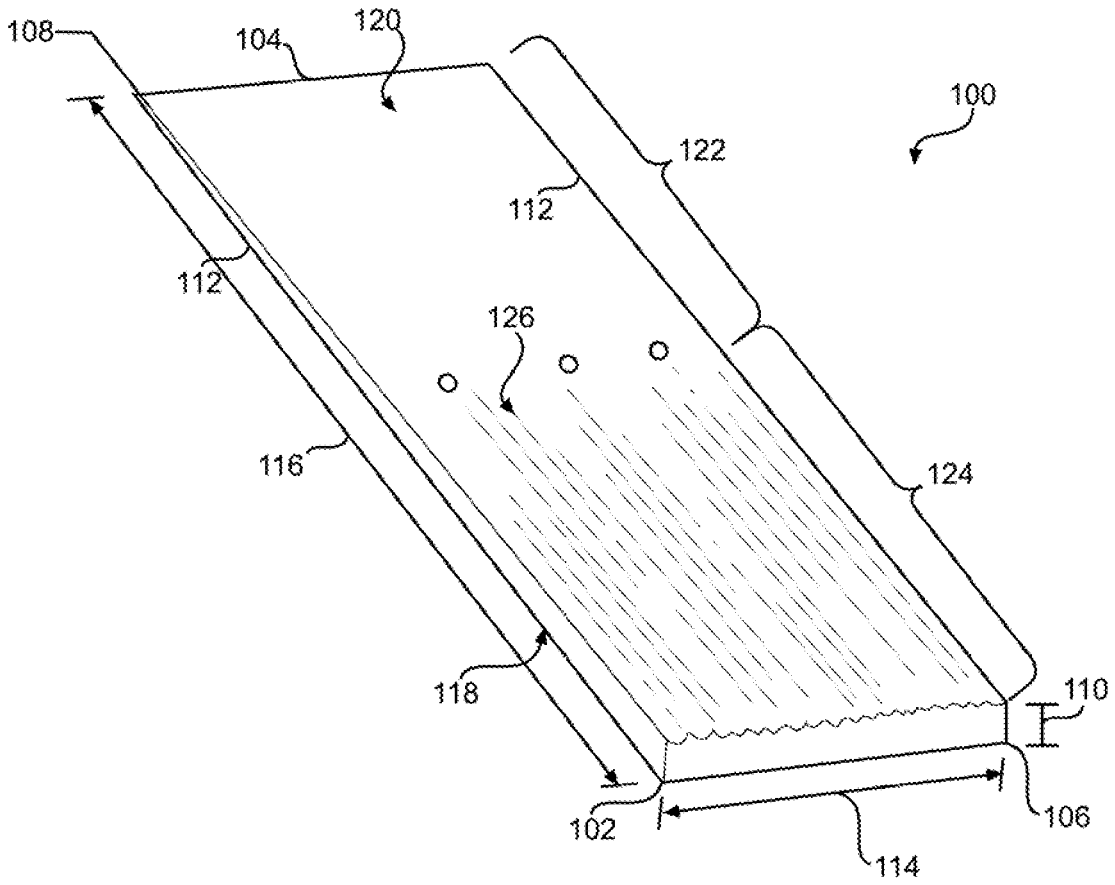
FIG. 1 is a perspective view of an exemplary roofing shake.
Figure 2:
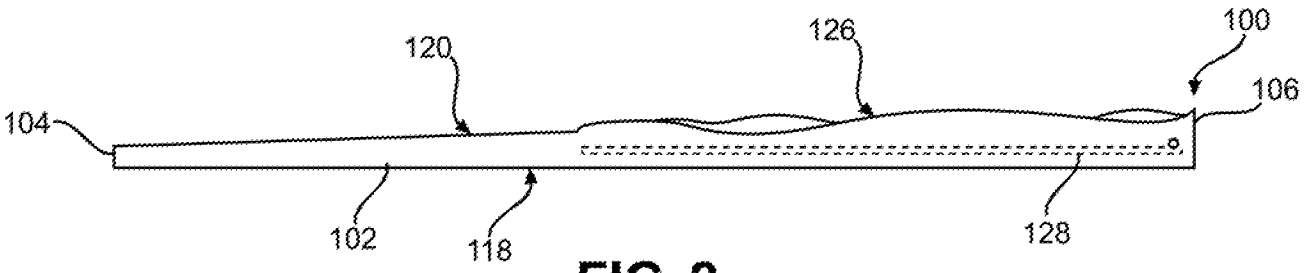
FIG. 2 is a side elevation view of the roofing shake.
Figure 3:
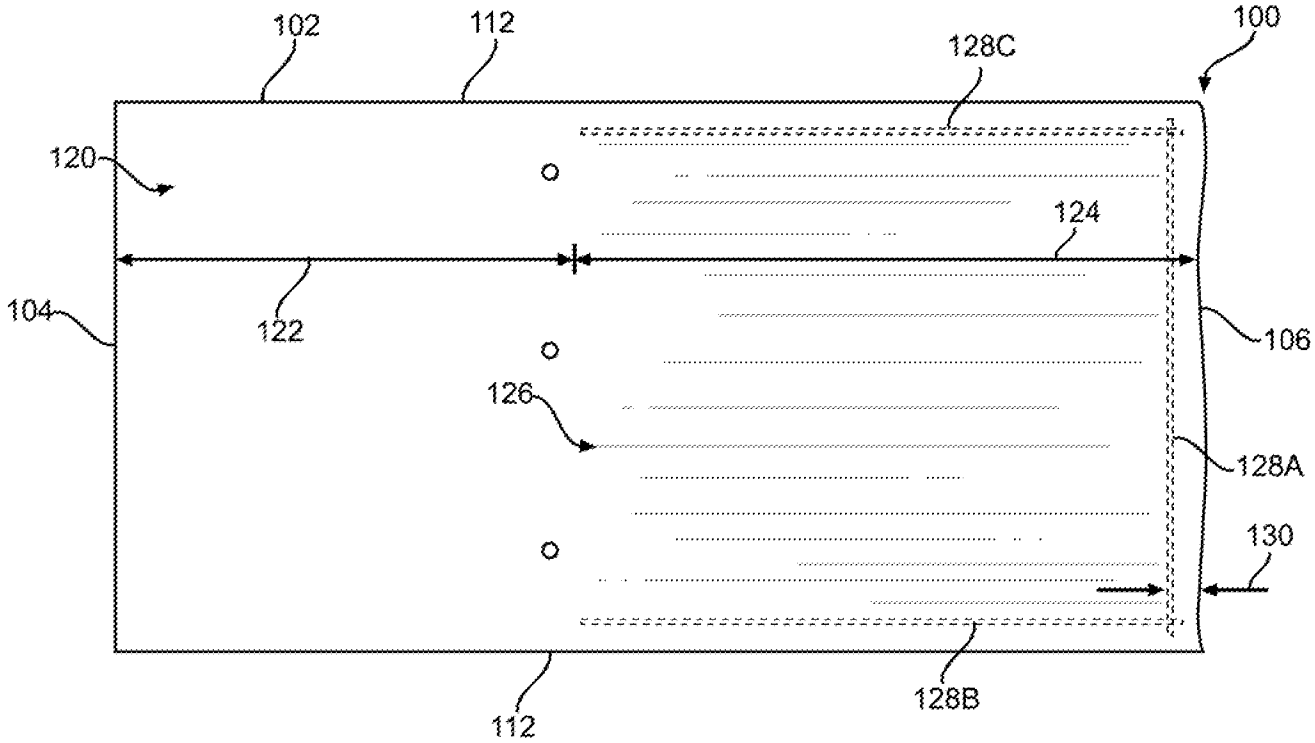
FIG. 3 is a top plan view of the roofing shake.

FIG. 1 is a perspective view of an exemplary roofing shake 100. FIG. 2 is a side elevation view of the roofing shake 100. FIG. 3 is a top plan view of the roofing shake 100. Referring concurrently to FIGS. 1-3, the roofing shake 100 may be used as a board, tile, shingle, shake, or other component for an interior or exterior portion of a residential or commercial structure. In aspects, shingles, shakes, tiles, and the like may be used on a roof or any other desired portion of a structure, and it may be used for decoration, protection, and/or insulation of the structure, as required or desired. In the example, the roofing shake 100 may have the appearance of cedar shakes, slate, or similar products made from natural materials, however, the roofing shake 100 is formed from a polymeric foam material, and may be formed by a reaction injection molding process. The molding process allows for different molds to be used for creating the roofing shake 100 and so that the appearance of each shake can be slightly varied.

Materials that may be used to form the roofing shake 100 include any material suitable for a reaction injection molding process, such as, but not limited to, thermoset polymers like polyurethanes, polyisocyanurates, polyureas, polyesters, polyphenols, polyexpoxides, and nylon 6. As such, the roofing shake 100 may be a relatively rigid foam product. In addition to the thermoset material(s), the roofing shake 100 may include one or more inert or reactive fillers, and/or other chemical or mineral components so as to increase any required or desired property or characteristic of the roofing shake 100. For example, flame retardant(s) can be added to inhibit or prevent flame propagation by protecting the underlying polymer matrix from the flame so that it does not burn (or further burn). In other examples, fillers may be provided to lower the cost of the mixture or to provide a desired property or characteristic, such as weather/UV resistance or increased strength. Material composition of the roofing shake 100 is further described in U.S. Pat. No. 10,011,992, titled "POLYMERIC FOAM PRODUCT," and which is incorporated by reference herein in its entirety.

In the example, the roofing shake 100 includes a body 102 formed from polymeric foam material having a first end 104 and an opposite second end 106. The first end 104 has a thickness 108 that is less than a thickness 110 of the second end 106 so that the body 102 has a tapered profile as shown in the side elevation view of FIG. 2. As such, the second end 106 is thicker than the first end 104, while the first end 104 is thinner than the second end 106. The first end 104 is a top edge of the roofing shake 100 and the second end 106 is a bottom edge of the roofing shake 100. Thus, when the roofing shake 100 is installed on a roof, the top edge is typically placed above the bottom edge for shake orientation. Side edges 112 extend between the top edge and the bottom edge to define a width 114 of the body 102. A length 116 of the body 102 is defined between the first end 104 and the second 106.

The body 102 has a rectangular shape as illustrated in the top plan view of FIG. 3. As such, the length 116 of the side edges 112 are longer than the width 114 of the top and bottom edges. In an aspect, the length 116 of the roofing shake 100 may be 231/2 inches, while the width 114 of the roofing shake 100 is shorter. In examples, the width 114 of the roofing shake 100 may be one of 5¼ inches, 7¼ inches, or 12¼ inches. Additionally, the thickness 108 of the first end 104 may be ⅛ inch and the thickness 110 of the second end 106 may be % inch. It should be appreciated that these dimensions of the roofing shake 100 are exemplary only and other dimensions are also contemplated herein.

Additionally, the body 102 has a bottom surface 118 configured to face a roofing structure when the roofing shake 100 is installed on a roof and an opposite top surface 120 that is at least partially exposed once the roof is installed. A first body portion 122 is disposed proximate the first end 104 and extends towards the second end 106. When the roofing shake 100 is installed on a roof, the top surface 120 of the first body portion 122 is configured to be secured to the roofing structure and at least partially covered by other roofing shakes that are installed on the layer above. In an aspect, the top surface 120 of the first body portion 122 may be substantially smooth. A second body portion 124 is disposed proximate the second end 106 and extends towards the first end 104. The first body portion 122 and the second body portion 124 are integral with one another such that the body 102 is of unitary construction (e.g., via a molding process). In the example, the first body portion 122 and the second body portion 124 extend approximately half of the length 116 of the body 102. In other aspects, the first body portion 122 may have a length that is greater than the second body portion 124. In still further aspects, the second body portion 124 may have a length that is greater than the first body portion 122. When the roofing shake 100 is installed on a roof, the top surface 120 of the second body portion 124 is configured to be exposed, and as such, includes a texture 126 that gives the roofing shake 100 the appearance of being natural cedar and the like.

As described above, the roofing shake 100 being installed on a roof or other structure results in the roofing shake 100 being exposed to a variety of environmental conditions. For example, UV-rays, hot and cold cycles, wind, rain, hail, and the like. As such, prolonged exposure to environmental conditions can result in exterior edges (e.g., bottom edge 106, and side edges 112) warping and/or curling up and away from the underlying structural surface. The more the exterior edges lift away from the underlying surface, the more wind affects the shake and further increases stresses induced on the shake. As such, in the example described herein one or more reinforcement members 128 are embedded within the body 102 of the roofing shake 100. The reinforcement members 128 increase the structural rigidity of the body 102 and reduce or prevent the exterior edges from warping and/or curling.

In the example, the reinforcement members 128 my be pultruded fiberglass rods. The fiberglass rods contain reinforcement fibers and a polymer resin matrix mix with glass delivering increased tensile strength and surrounding fibers providing enhanced resistance to buckling and corrosion plus increased durability. The fiberglass rods may be independently manufactured and then selectively placed in the shake molds during the reaction injection molding process. By adding discrete components (e.g., the fiberglass rods) into the injection molding process, the polymeric foam material that forms the body 102 does not need to have its composition adjusted. Thereby, increasing manufacturing efficiencies of the roofing shake 100 while increasing its strength and durability with the reinforcement members 128. Additionally, the polymeric foam material can easily bond to the fiberglass rods during the molding process. As such, the reinforcement members 128 are not added into the mixture of the polymeric foam material until the molding process. In an aspect, the fiberglass rods are substantially not flexible in that the roofing shake 100 does not bend during installation and use.

The reinforcement members 128 are disposed within the second body portion 124 and are positioned adjacent to the outer perimeter edges of the second body portion 124. For example, the reinforcement member 128 are positioned along the second end 106 and portions of the side edges 112. In an example, the reinforcement members 128 have a U-shaped configuration and are only disposed along the outer perimeter edges of the second body portion 124. As such, the interior region of the U-shape is devoid of any additional reinforcement members and is only filled with polymeric foam material. This configuration of the reinforcement members 128 within the body 102, maintains the structural characteristics and performance of the polymeric foam material (e.g., strength, weight, fire resistance) while further enhancing the roofing shake's resistance to lifting and curling along its outer edges via the reinforcement members 128. The reinforcement members 128 are not randomly oriented within the body 102 of the roofing shake 100, and rather, are selectively placed for reinforcement of the outside edges of the body 102 to restrict or prevent warping and curling during use.

Furthermore, the configuration of the reinforcement members 128 corresponding to the outer perimeter of the body 102 enables the reaction injection molding process to remain unchanged even with the additional reinforcement members 128 within the mold. If the reinforcement members extend more across the interior area of the body 102 (e.g., like a grid pattern) or if a mesh reinforcement is used, the polymeric foam material is restricted from flowing throughout the mold during the molding process and prior to expansion. As such, the U-shaped configuration of the reinforcement members 128 allows the polymeric foam material to properly flow within the mold during manufacturing.

Additionally, the top body portion 122 does not contain and is devoid any reinforcement members 128. The top body portion 122 is configured to receive fasteners so that the roofing shake 100 can be secured to the underlying roofing structure. By not placing reinforcement members 128 in the top body portion 122, installers do not need to be concerned about fastening through a reinforcement member during installation, and the polymeric foam material can more easily flow through the mold during the manufacturing process and as described above. The reinforcement members 128 are not disposed evenly through the body 102 of the roofing shake 100. Rather, the reinforcement members 128 are concentrated in the bottom body portion 124 and towards the outer perimeter edges thereof.

In the example, the reinforcement members include three discrete members, a cross-member 128*a* extending parallel to the bottom edge 106 and two side-members 128*b,c* extending parallel to one another and the side edges 112, longitudinally between the first and second ends 104, 106. The cross-member 128*a* extends transversely relative to the two side-members 128*b,c*, and thus, the side-members 128*b,c* are each orthogonal to the cross-member 128*a*. In an aspect, the two side-members 128*b,c* may have equal lengths, with the length of the cross-member 128*a* based on the width 114 of the body 102. The lengths of the two side-members 128*b,c* may be shorter than half of the length 116 of the roofing shake 100 so that the reinforcement members do not extend out of the second body portion 124 and into the first body portion 122. In some aspects, each of the reinforcement members 128 may have equal lengths so as to increase manufacturing efficiencies. In this example, the length of the reinforcement members 128 can be based at least partially on the width 114 of the body 102. The reinforcement members 128 are oriented substantially parallel and/or orthogonal to one another within the body 102. This configuration more efficiently reinforces the outer perimeter edges from warping and curling forces without interfering the structural integrity of the rest of the body 102 of the roofing shake 100.

The cross-member 128*a* that is positioned along the bottom edge 106 overlaps with and directly contacts the side-members 128*b,c* positioned along the side edges 112. In an aspect, the cross-member 128*a* is positioned between the top surface 120 and the side-members 128*b,c* as illustrated in FIG. 2. In other aspects, the cross-member 128*a* may be positioned between the bottom surface 118 and the side-members 128*b,c*. By overlapping the reinforcement members at the bottom corners of the body 102, the strength of the corners increase and lifting and curling at the corners is reduced or prevented. Additionally, the reinforcement members 128 can be coupled together (e.g., via a tie not shown) so that the U-shaped configuration of the reinforcement members 128 can be maintained during the manufacturing process. In some aspects, the ends of the rods can extend past the adjacent rod to facilitate this coupling.

The reinforcement members 128 are embedded within the body 102 so that the aesthetic features of the outer surface are maintained for the roofing shake 100. As such, in one example, the reinforcement members 128 are inset 130 from the outer edges at least a distance that corresponds to the thickness 110 of the second end 106 of the body 102. In an aspect, the inset distance 130 of the cross-member 128*a* is the same or similar to that of the side-members 128*b,c*. In other aspects, the inset distance 130 of the cross-member 128*a* is different than that of the side-members 128*b,c* as required or desired.

In the example, the reinforcement members 128 may include 3/16 inch diameter round fiberglass rods. In another example, the reinforcement members 128 may include 3/16 inch square fiberglass rods. In an aspect, the reinforcement members 128 may be about 10 inches long. In some examples, the reinforcement members 128 are covered by a layer of polymeric foam product that is at least equal to the diameter of the reinforcement rods.

Figure 4:
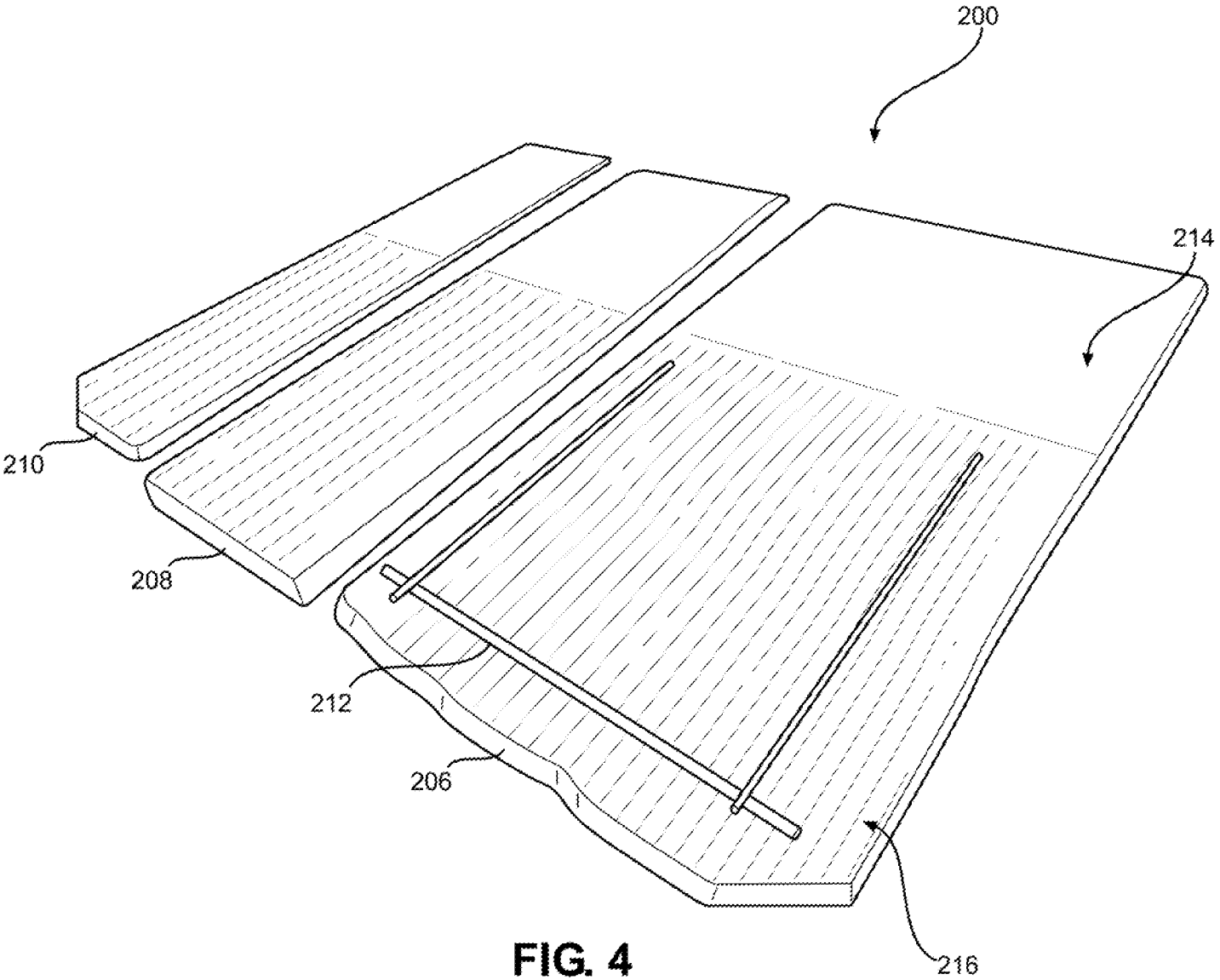
FIG. 4 is a component view of an exemplary roofing shake system.
Figure 5:
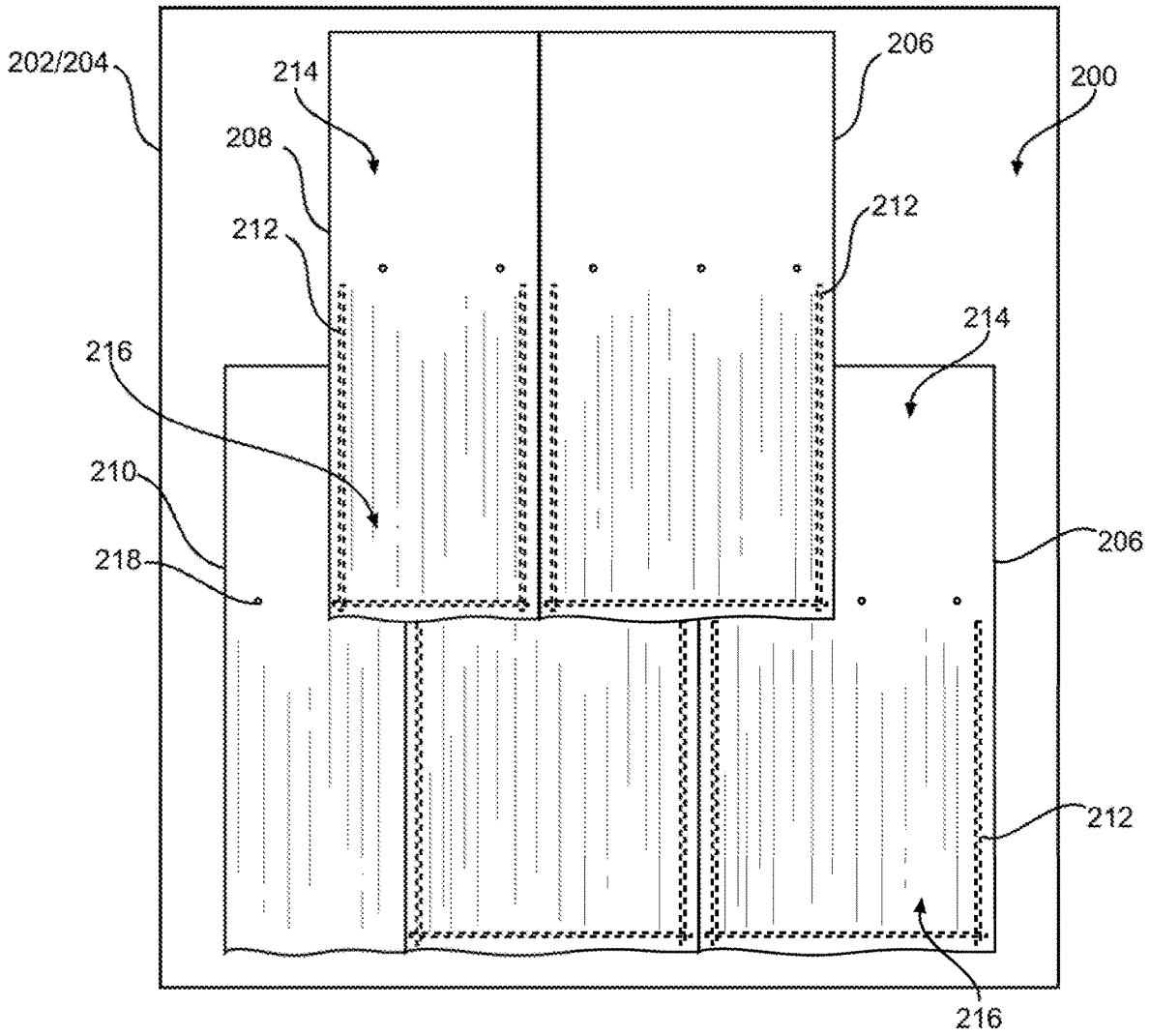
FIG. 5 is a schematic view of the roofing shake system shown in FIG. 4 installed on a roof structure.

FIG. 4 is a component view of an exemplary roofing shake system 200. FIG. 5 is a schematic view of the roofing shake system 200 installed on a roof structure 202. Referring concurrently to FIGS. 4 and 5, the roofing shake system 200 includes a plurality of roofing shakes configured to be attachable to an underlying structure. In the example, the underlying structure is a roof structure 202 having a roofing membrane 204 to restrict moisture penetration. The roofing shakes are configured to be attached to the roof structure 202 by one or more fasteners (e.g., nails or the like) that secure the shake to the structure.

In the example, the plurality of roofing shakes may include any number of shakes that have different widths. For example, a large shake 206, a medium shake 208, and a small shake 210 may be included with the plurality of roofing shakes. As described above, one or more of the shakes 206, 208, 210 include reinforcement members 212 that are embedded therein. As illustrated in FIG. 4, the reinforcement members 212 are shown as laying above the large shake 206 for clarity as in the final product the reinforcement members 212 are not visible. The reinforcement members 212 are not coupled to or disposed on the outer surfaces of the roofing shakes. As described in the above example, the reinforcement members 212 include three bars that extend partially around the outer perimeter edges of the roofing shakes. In an aspect, each of the large, medium, and small shakes can include the reinforcement members 212 as described herein. In the example, wider shakes (e.g., the large and/or medium shakes) tend to have their exposed edges lift and curl more than the smaller shakes. As such, in aspects, the small and/or medium shakes 208, 210 may not include any reinforcement members 212 as required or desired.

Each shake 206, 208, 210 has a top body portion 214 and a bottom body portion 216. The top body portion 214 has a top surface that is substantially smooth and without texture. In contrast, the top surface of the bottom body portion 216 includes texture and the bottom body portion 216 is configured to be exposed when installed on the roof structure 202. Each of the shakes 206, 208, 210 attaches to the roof structure 202 with one or more fasteners 218 extending through the top body portion 214. Because of the reinforcement members 212 are not disposed within the top body portion 214, the fasteners 218 do not contact the reinforcement members 212 during installation.

During installation, the shakes 206, 208, 210 are installed in layered rows, with a bottom layer of shakes being partially overlapped with a top layer of shakes. In the example, the bottom surface of the bottom body portion 216 of the top layer overlays the top surface of the top body portion 214 of the bottom layer. In this pattern, the reinforcement members 212 of the bottom layer of shakes are separate from and do not overlap with the reinforcement members 212 of the top layer of shakes. By not overlapping reinforcement members 212 of the shakes, the manufacturing costs of the shakes are reduced, while still providing additionally structural support for lifting and curling of the outer edges of the shakes. Additionally, the reinforcement members 212 increases the shake's resistance to wind loads with the top body portion 214 being at least partially covered with the reinforced bottom body portion 216.

In some examples, a starter shake (not shown) may be provided to start the installation of the shakes 206, 208, 210 on the roof structure 202. This starter shake can have a same or similar tapered shape, and in some aspects, also include reinforcement members as required or desired. Additionally or alternatively, a ridge shake (not shown) may be provided to install over ridge lines of the roof structure 202. This ridge shake can also include reinforcement members as required or desired.

Figure 6:
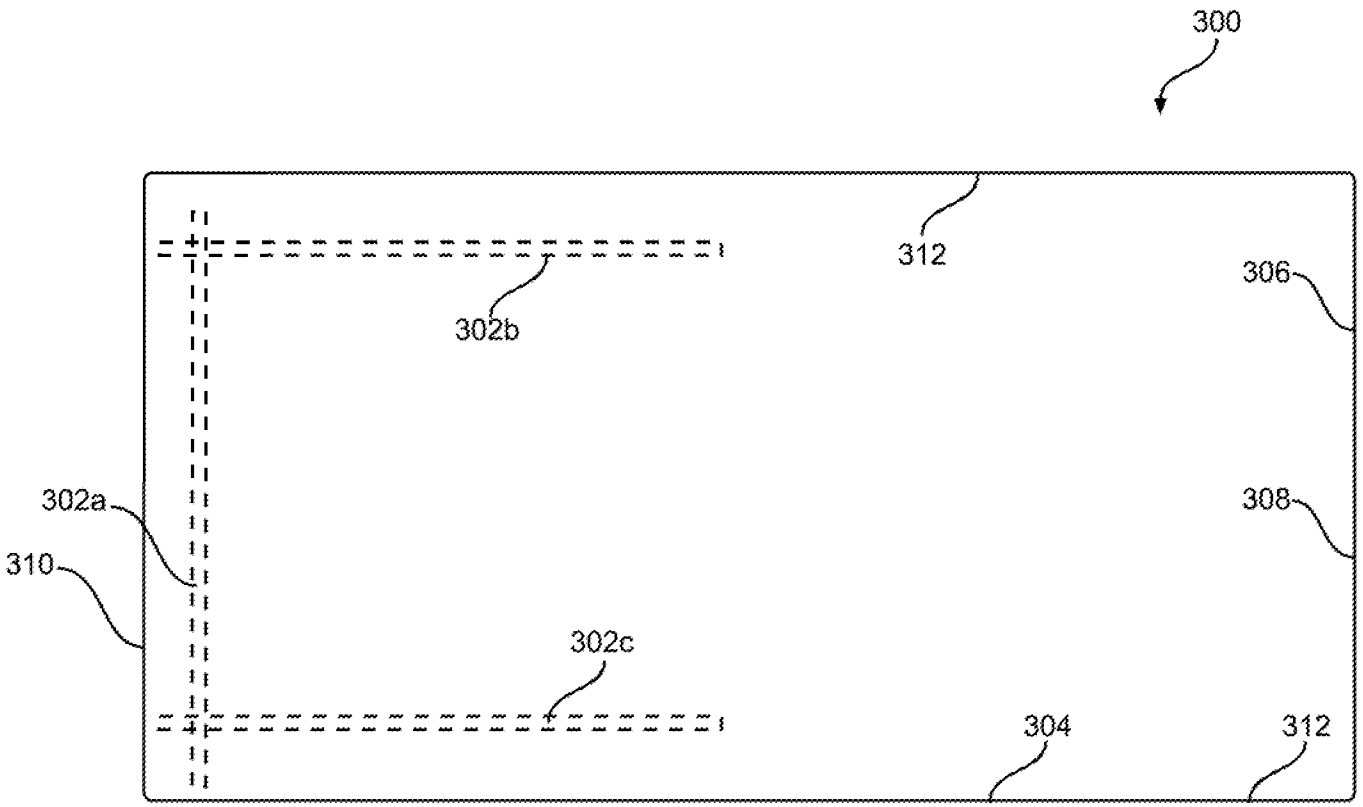
FIG. 6 is a top plan view of another exemplary roofing shake.
Figure 7:
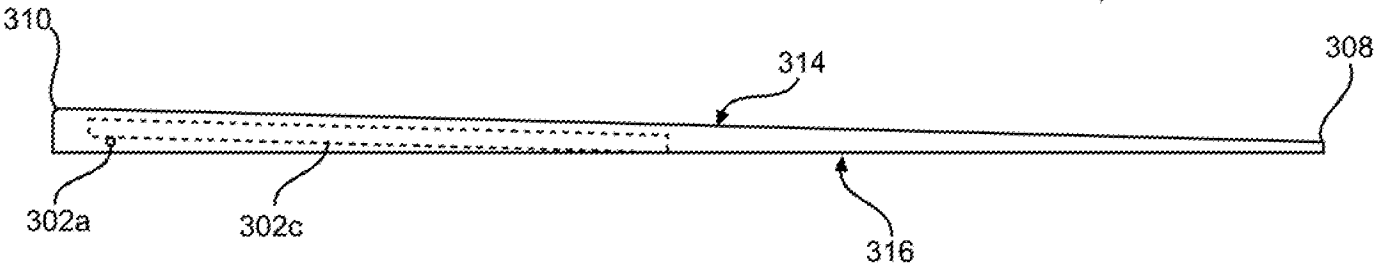
FIG. 7 is a side elevation view of the roofing shake shown in FIG. 6.
Figure 8:
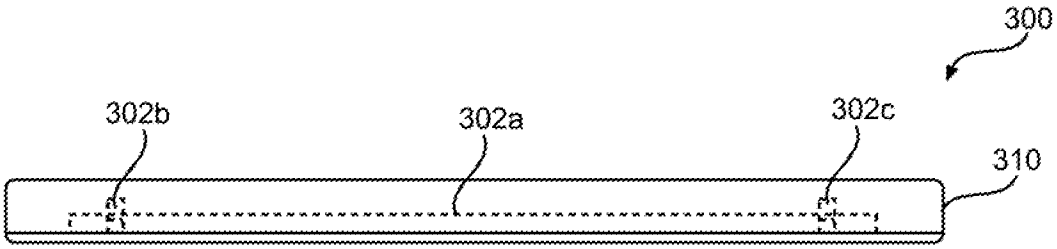
FIG. 8 is an end elevation view of the roofing shake shown in FIG. 6.

FIG. 6 is a top plan view of another exemplary roofing shake 300. FIG. 7 is a side elevation view of the roofing shake 300. FIG. 8 is an end elevation view of the roofing shake 300. Referring concurrently to FIGS. 6-8, the roofing shake 300 can be formed by a polymeric foam material as described above and has a plurality of reinforcement bars 302. The roofing shake 300 is substantially rectangular shaped, and in an aspect, has a length 304 of 23½ inches and a width 306 of 12¼ inches. However, it is appreciated that the shake 300 can take on other dimensions as required or desired. In the example, the roofing shake 300 has a tapered cross-sectional profile with a top end 308 being thinner (e.g., ⅛ inch) when compared to an opposite bottom end 310 (e.g., % inch).

The reinforcement bars 302 are disposed proximate the bottom end 310 and there are three reinforcement bars 302 extending along the outer perimeter shape profile of the roofing shake 300. In the example, one reinforcement bar 302*a* extends along the width direction of the shake, while two reinforcement bars 302*b,c* extend along the length direction of the shake and on opposing sides. Each of the reinforcement bars 302 can be 3⁄16 inch diameter round rods or 3⁄16 inch diameter square rods being 10½ inches in length. The reinforcement bar 302*a* is spaced from the bottom end 310 one inch from its centerline. The reinforcement bars 302*b,c* are spaced from side edges 312 1½ inches from its centerline. By increasing the space of the lengthwise reinforcement bars 302*b,c* from the edges 312, the polymeric material can more easily flow lengthwise in the mold during the manufacturing process. The ends of the reinforcement bars 302 are spaced at least ½ inch from the edges of the shake 300.

The widthwise reinforcement bar 302*a* overlaps with and contacts with the lengthwise reinforcement bars 302*b,c*. In the example, the widthwise bar 302*a* is disposed below the lengthwise bars 302*b,c*. As such, the lengthwise bars 302*b,c* are substantially parallel to a top surface 314 of the roofing shake 300 while being oblique to a bottom surface 316 of the shake 300. The widthwise bar 302*a* can be substantially parallel to the bottom surface 316. This configuration of the reinforcement bars 302 results in in reinforcement being provided to the roofing shake 300 in a form that is not a mat or mesh so that the molding process is maintained and the reinforcement is selectively placed in locations that increase the performance of the roofing shake the most, as the plyometric foam material already has many performance benefits that are not changed.

In the example, the majority of the body of the roofing shake 300 is formed from the polymeric foam material with the reinforcement bars 302 only a minor component of the entire body. In an aspect, the ratio of reinforcement bars 302 to the body of the roofing shake can be less than 5% by volume. In another aspect, the ratio of reinforcement bars 302 to the body of the roofing shake can be between 0.5-2% by volume. In still another aspect, the ratio of reinforcement bars 302 to the body of the roofing shake can be about 1% by volume. Additionally or alternatively, the ratio of reinforcement bars 302 to the body of the roofing shake can be less than 5% by top plan area. In another aspect, the ratio of reinforcement bars 302 to the body of the roofing shake can be between 1-3% by top plan area. In still another aspect, the ratio of reinforcement bars 302 to the body of the roofing shake can be about 2% by top plan area.

Notwithstanding the appended claims, and in addition to the examples described above, further examples are disclosed in the following numbered clauses:

1. A roofing shake including:
   - a first end and an opposite second end, wherein the roofing shake has a tapered profile such that the second end is thicker than the first end;
   - a bottom surface configured to face a roofing structure when the roofing shake is installed on a roof and an opposite top surface;
   - a first body portion disposed proximate the first end, wherein the top surface of the first body portion is configured to be at least partially covered by one or more other roofing shakes;
   - a second body portion disposed proximate the second end; and
   - one or more reinforcement members embedded within the roofing shake and within the second body portion, the one or more reinforcement members positioned adjacent an outer perimeter edge of the second body portion.

2. The roofing shake of clause 1, wherein the one or more reinforcement members have a U-shaped configuration.

3. The roofing shake of any one of clauses 1 or 2, wherein the one or more reinforcement members include three discrete reinforcement rods, wherein at least two of the three discrete reinforcement rods have equal lengths.

4. The roofing shake of any one of clauses 1-3, wherein the one or more reinforcement members include three discrete reinforcement rods, two reinforcement rods extending longitudinally between the first and second ends and one reinforcement rod extending transversely along the second end, wherein the one reinforcement rod overlaps with both of the two reinforcement rods.

5. The roofing shake of clause 4, wherein the one reinforcement rod directly contacts each of the two reinforcement rods.

6. The roofing shake of any one of clauses 1-5, wherein the one or more reinforcement members include fiberglass rods.

7. The roofing shake of any one of clauses 1-6, wherein a length is defined between the first end and the second end, wherein the one or more reinforcement members are shorter than half of the length of the roofing shake.

8. The roofing shake of any one of clauses 1-7, wherein the one or more reinforcement members are inset from the outer perimeter edge a distance that is greater than or equal to a thickness of the second end.

9. A roofing shake including:

a body formed from polymeric foam material, the body including:

opposite top and bottom edges, the top edge being thinner than the bottom edge;

opposite side edges extending between the top and bottom edges, wherein the top and bottom edges and the side edges are arranged in a rectangular shape with the side edges longer than the top and bottom edges;

opposite first and second surfaces;

a top portion configured to be secured to a roofing structure; and a bottom portion, the first surface of the bottom portion being textured; and a plurality of reinforcement members embedded within the body and disposed within the bottom portion, the plurality of reinforcement members extending adjacent the bottom edge and the side edges.

10. The roofing shake of clause 9, wherein the plurality of reinforcement members have a U-shaped configuration, the interior of the U-shape being devoid of any additional reinforcement members.

11. The roofing shake of any one of clauses 9-10 wherein the plurality of reinforcement members include three discrete reinforcement rods, each of the three discrete reinforcement rods having equal lengths.

12. The roofing shake of any one of clauses 9-11, wherein a reinforcement member along the bottom edge, overlaps with and directly contacts reinforcement members along the side edges.

13. The roofing shake of any one of clauses 9-12, wherein the plurality of reinforcement members include fiberglass rods.

14. The roofing shake of any one of clauses 9-13, wherein the top portion is devoid of any reinforcement members.

15. The roofing shake of any one of clauses 9-14, wherein the bottom portion is approximately half of a length of the roofing shake between the top and bottom edges.

16. The roofing shake of any one of clauses 9-15, wherein the body is formed by a reaction injection molding process.

17. A roofing shake system including:

a plurality of roofing shakes including:

opposite top and bottom surfaces, the bottom surface configured to face a roofing structure;

a first body portion having a first edge;

a second body portion having a second edge opposite of the first edge, the first body portion integral with the second body portion and the second edge having a thickness that is greater than a thickness of the first edge; and three reinforcement members embedded within the second body portion and arranged in a U-shape with a cross-member extending parallel to the second edge, wherein each of the plurality of roofing shakes is attachable to the roofing structure via one or more fasteners extending through the first body portion such that the bottom surface of the second body portion of a first roofing shake at least partially overlays the top surface of the first body portion of a second roofing shake, and wherein the three reinforcement members of the first roofing shake are separate from and do not overlap with the three reinforcement members of the second roofing shake when attached to the roofing structure.

18. The roofing shake system of clause 17, wherein the top surface of the second body portion is textured.

19. The roofing shake system of any one of clauses 17 or 18, wherein the first roofing shake and the second roofing shake have different widths.

20. The roofing shake system of any one of clauses 17-19, wherein each roofing shake is formed from polymeric foam material and each of the three reinforcement members are formed from fiberglass rods.

This disclosure describes some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art. Any number of the features of the different examples described herein may be combined into one single example and alternate examples having fewer than or more than all of the features herein described are possible. Further, as used herein and in the claims, the phrase "at least one of element A, element B, or element C" is intended to convey any of: element A, element B, element C, elements A and B, elements A and C, elements B and C, and elements A, B, and C. It is to be understood that terminology employed herein is used for the purpose of describing particular examples only and is not intended to be limiting. It must be noted that, as used in this specification, the singular forms "a," "an," and "the" include plural referents unless the context clearly dictates otherwise. Further, one having skill in the art will understand the degree to which terms such as "about" or "substantially" convey in light of the measurement techniques utilized herein. To the extend such terms may not be clearly defined or understood by one having skill in the art, the terms such as "about" or "substantially" shall mean plus or minus ten percent.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. A roofing shake comprising:

a first end and an opposite second end, wherein the roofing shake has a tapered profile such that the second end is thicker than the first end;

a bottom surface configured to face a roofing structure when the roofing shake is installed on a roof and an opposite top surface;

a first body portion disposed proximate the first end, wherein the top surface of the first body portion is configured to be at least partially covered by one or more other roofing shakes;

a second body portion disposed proximate the second end; and one or more reinforcement members embedded within the second body portion, the one or more reinforcement members positioned adjacent an outer perimeter edge of the second body portion, wherein a length is defined between the first end and the second end, wherein the one or more reinforcement members are shorter than half of the length of the roofing shake.

2. The roofing shake of claim 1, wherein the one or more reinforcement members have a U-shaped configuration.

3. The roofing shake of claim 1, wherein the one or more reinforcement members include three discrete reinforcement rods, wherein at least two of the three discrete reinforcement rods have equal lengths.

4. The roofing shake of claim 1, wherein the one or more reinforcement members include three discrete reinforcement rods, two reinforcement rods extending longitudinally between the first and second ends and one reinforcement rod extending transversely along the second end, wherein the one reinforcement rod overlaps with both of the two reinforcement rods.

5. The roofing shake of claim 4, wherein the one reinforcement rod directly contacts each of the two reinforcement rods.

6. The roofing shake of claim 1, wherein the one or more reinforcement members include fiberglass rods.

7. The roofing shake of claim 1, wherein the one or more reinforcement members are inset from the outer perimeter edge a distance that is greater than or equal to a thickness of the second end.

8. A roofing shake comprising:

a body formed from polymeric foam material, the body comprising:

opposite top and bottom edges, the top edge being thinner than the bottom edge;

opposite side edges extending between the top and bottom edges, wherein the top and bottom edges and the side edges are arranged in a rectangular shape with the side edges longer than the top and bottom edges;

opposite first and second surfaces;

a top portion configured to be secured to a roofing structure; and a bottom portion, the first surface at the bottom portion being textured; and a plurality of reinforcement members embedded within the body and disposed within the bottom portion, the plurality of reinforcement members extending adjacent the bottom edge and the side edges, wherein the plurality of reinforcement members have a U-shaped configuration, the interior of the U-shape being devoid of any additional reinforcement members.

9. The roofing shake of claim 8, wherein the plurality of reinforcement members include three discrete reinforcement rods, each of the three discrete reinforcement rods having equal lengths.

10. The roofing shake of claim 8, wherein a reinforcement member along the bottom edge, overlaps with and directly contacts reinforcement members along the side edges.

11. The roofing shake of claim 8, wherein the plurality of reinforcement members include fiberglass rods.

12. The roofing shake of claim 8, wherein the top portion is devoid of any reinforcement members.

13. The roofing shake of claim 8, wherein the bottom portion is approximately half of a length of the roofing shake between the top and bottom edges.

14. The roofing shake of claim 8, wherein the body is formed by a reaction injection molding process.

15. A roofing shake system comprising:

a plurality of roofing shakes comprising:

opposite top and bottom surfaces, the bottom surface configured to face a roofing structure;

a first body portion having a first edge;

a second body portion having a second edge opposite of the first edge, the first body portion integral with the second body portion and the second edge having a thickness that is greater than a thickness of the first edge; and three reinforcement members embedded within the second body portion and arranged in a U-shape with a cross-member extending parallel to the second edge, wherein each of the plurality of roofing shakes is attachable to the roofing structure via one or more fasteners extending through the first body portion such that the bottom surface of the second body portion of a first roofing shake at least partially overlays the top surface of the first body portion of a second roofing shake, and wherein the three reinforcement members of the first roofing shake are separate from and do not overlap with the three reinforcement members of the second roofing shake when attached to the roofing structure.

16. The roofing shake system of claim 15, wherein the top surface of the second body portion is textured.

17. The roofing shake system of claim 15, wherein the first roofing shake and the second roofing shake have different widths.

18. The roofing shake system of claim 15, wherein each roofing shake is formed from polymeric foam material and each of the three reinforcement members are formed from fiberglass rods.

* * * * *